US008137208B2

(12) United States Patent
Ahem et al.

(10) Patent No.: US 8,137,208 B2
(45) Date of Patent: Mar. 20, 2012

(54) AUTOMATIC REAL-TIME GAME SCORING DEVICE AND GOLF CLUB SWING ANALYZER

(75) Inventors: Frank Ahem, Scottsdale, AZ (US); Charles Mollo, Scottsdale, AZ (US)

(73) Assignee: Innoventions Partners, LLC, Scottsdale, AZ (US)

( * ) Notice: Subject to any disclaimer, the term of this patent is extended or adjusted under 35 U.S.C. 154(b) by 365 days.

(21) Appl. No.: 12/386,191

(22) Filed: Apr. 15, 2009

(65) Prior Publication Data

US 2010/0099509 A1 Apr. 22, 2010

Related U.S. Application Data

(60) Provisional application No. 61/195,857, filed on Oct. 10, 2008.

(51) Int. Cl.
*A63B 57/00* (2006.01)
*G06F 19/00* (2006.01)

(52) U.S. Cl. ..... 473/221; 473/407; 473/92

(58) Field of Classification Search ..... 473/131, 473/221, 223, 282, 407, 409; 700/92
See application file for complete search history.

(56) References Cited

U.S. PATENT DOCUMENTS

| | | | | |
|---|---|---|---|---|
| 5,616,832 | A * | 4/1997 | Nauck | 73/65.03 |
| 2003/0144069 | A1* | 7/2003 | Erickson et al. | 473/282 |
| 2006/0178110 | A1* | 8/2006 | Nurminen et al. | 455/41.2 |
| 2007/0010341 | A1* | 1/2007 | Miettinen et al. | 473/131 |
| 2009/0143882 | A1* | 6/2009 | Young | 700/91 |
| 2009/0209358 | A1* | 8/2009 | Niegowski | 473/223 |

* cited by examiner

*Primary Examiner* — Peter DungBa Vo
*Assistant Examiner* — Mukund G Patel
(74) *Attorney, Agent, or Firm* — Robert C. Klinger

(57) ABSTRACT

An automatic real-time game scoring device and golf club swing analyzer which may include enhanced capability based on GPS parametric and golf course specific information. One aspect of the invention includes the capability to assess a player's swing as a function of ball strike, club information, and length of an actual golf shot. In another aspect of the invention, the device provides for scoring a game as a function of the club used, the shot characteristics, and specific course parameter such as the hole played, game conditions, which may be analyzed during game play, as well as post game. The system presented according to the present invention is capable of adding to an individual's score only actual golf ball shots while ignoring practice swings. For recreational golf, the system allows for user overrides ("whiffs" and "mulligans") at the golfer's digression.

25 Claims, 12 Drawing Sheets

COURSE: XX
DATE: XX

DATE + -

| CLUB | AVERAGE DISTANCE | BEST D | LOWEST D | AVERAGE OMITING BEST/WORST SHOT |
|---|---|---|---|---|
| W1 | 237 | 261 | 190 | 234 |
| W2 | | | | |
| W3 | | | | |
| H3 | | | | |
| H5 | | | | |
| I2 | | | | |
| I3 | | | | |
| I4 | | | | |
| I5 | | | | |
| I6 | | | | |
| I7 | | | | |
| I8 | | | | |
| I9 | | | | |
| PW | | | | |
| SW | | | | |
| P | | | | |

+ -

FIGURE 11

AUTOMATIC REAL-TIME GAME SCORING DEVICE AND GOLF CLUB SWING ANALYZER

CLAIM OF PRIORITY

The present application claims priority of U.S. Provisional Application Ser. No. 61/195,857 filed Oct. 10, 2008 entitled "GOLF SWINGER", the teaching of which are incorporated herein by reference.

FIELD OF THE INVENTION

The present invention is generally directed to golf club devices, and more particularly to game performance tracking and swing analysis.

BACKGROUND OF THE INVENTION

The game of golf is complex given the numerous elements that affect a golf shot. The basic physical properties include the properties of the golf club, the ball, as well as the ball lie and weather conditions. The more complex aspects involve the golf swing and the ball strike, which are the subject of detail analysis by golf instructors, as well as equipment designed to analysis a club swing.

Due to the aforementioned complexities even the simple act of accurately detecting a golf shot allowing for automatic scoring has not been reliably achieved, therefore, to this day a round has required manual input from the golfer. Such a requirement often leads to inaccurate scoring, distraction from the game, and loss of enjoyment.

An important aspect in improving one's game of golf is a need to be able to review the cause-and-effect relationships that result during each and every swing. Again considering the complexities mentioned above this can only be done accurately during actual play. The basic factors of such an analysis may be the club used, the distance the ball traveled, the effects the swing had on the ball travel (such hook or slice), and the hole/golf course in which these results occurred. This cause-and-effect relationship ultimately is the result of the golfer's club speed, swing profile, body/head positions and other parameters throughout the swing.

While some of the swing analysis methods utilized by Renee Russo in the movie Tin Cup may not possess practical value, more complex devices utilized to ascertain/estimate swing parameters during practice can be found at local golf instruction centers. However, these complex swing analyzers are not suitable for use during golf play on an actual course. Moreover, these analyzers do not provide statistics of an actual golf shot during play, and as a function of real world conditions.

SUMMARY OF INVENTION

The present invention achieves technical advantages utilizable during actual game play which include game scoring capability, and as a golf club swing analyzer based game specific parameters, such as golf club used, on a GPS parameter(s), golf course/hole specific information, and other parameters. One aspect of the invention includes the capability to assess a player's swing as a function of ball strike, club information, and length of an actual golf shot as a function of real world conditions.

In another aspect of the invention is a system that provides for post game analysis, such as analyzing game data to appreciate actual game play, correlate common data, such as average length of shot for a particular club, as a function of a ball lie, such as fairway, rough, sand. The data can be utilized by a processor, such as a common PC or a PDA application, to provide the golfer data that is actually useful.

BRIEF DESCRIPTION OF THE DRAWINGS

FIG. 10-12 are visual renditions of displays that may created by scoring devices according to one embodiment;

DETAILED DESCRIPTION OF PREFERRED EMBODIMENTS

Figure 1:
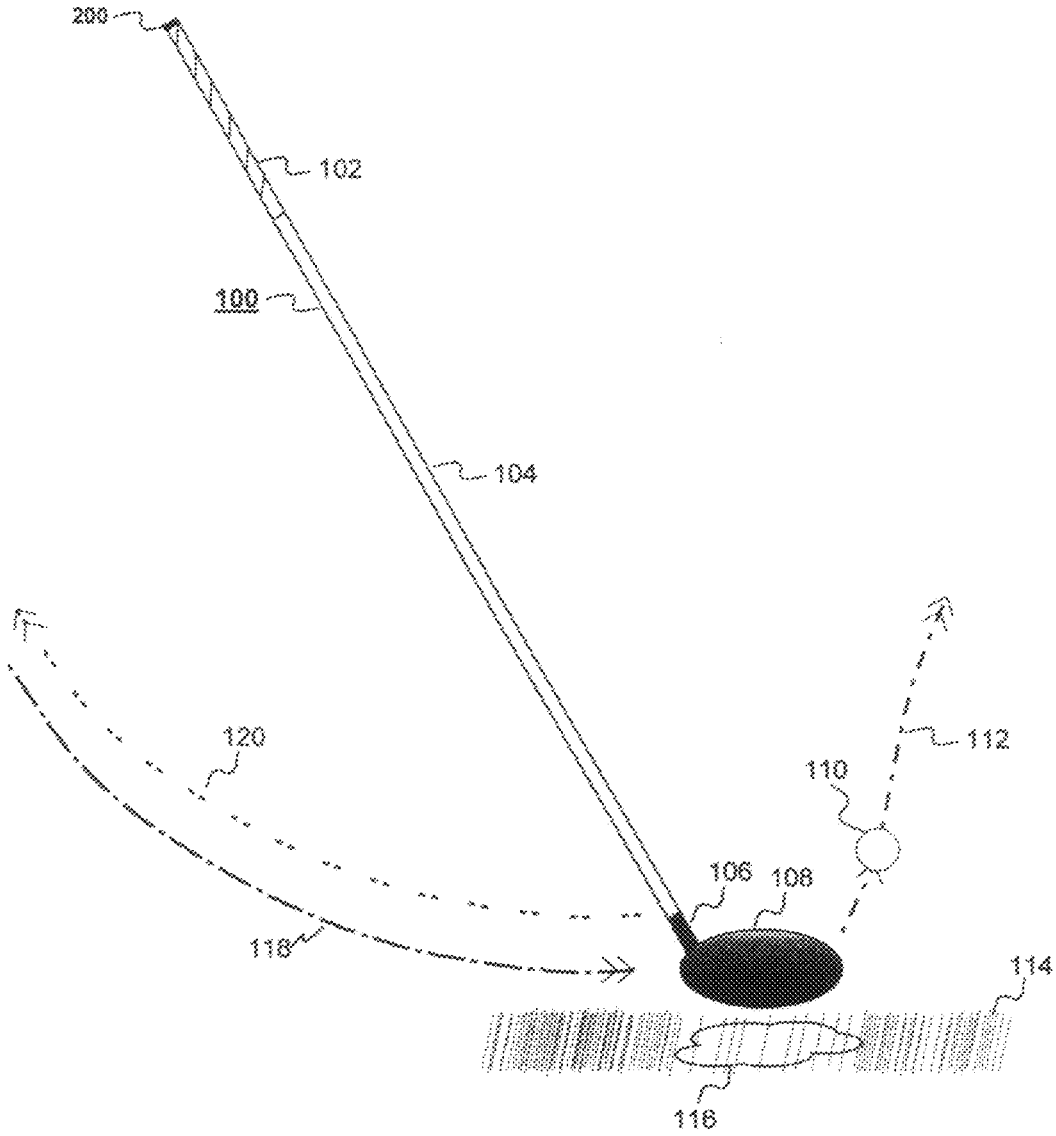
FIG. 1 is a perspective view of a typical golf club showing one placement of a golf scoring system swing detector and/or club identifier, facilitating detecting an actual golf ball strike during actual play, and analysis of club swing profiles during actual game play as discussed throughout the various embodiments.

Referring to FIG. 1 a typical golf club 100 is represented. Shown also in FIG. 1 is the addition of a device that may include a swing detector 200 attached to golf club 100, shown in this embodiment at the top of the club's grip 102 in one preferred embodiment of the invention. The detector 200 is configured to detect an actual golf shot event, such as detecting the shaft 104's motion and/or vibrations, such as a resonant frequency indicative of a ball strike or a jolt, or a sound indicative of an actual ball strike during golf play. The detector 200 may include an accelerometer and or other sensor elements configured to detect an actual golf swing and/or ball strike. The detector may be located at another location on or in the club, or integrated with the grip as desired. The detector 200 is configured to generate a signal indicative of an actual ball strike during the actual play of golf.

FIG. 1 also shows for illustration a ball 110 that may have a path 112 when struck by the club, a playing surface 114, a divot 116, a club head swing path 118, and a club head backswing path 120.

Figure 2A:
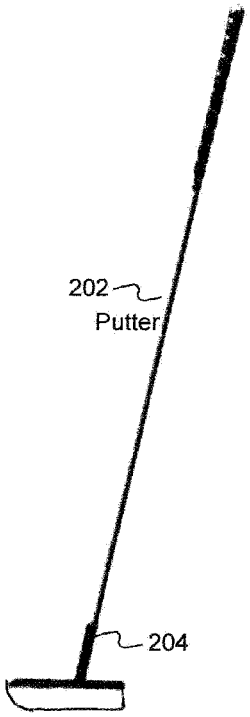
FIGS. 2A, 2B, 2C shows multiple locations of swing detectors and/or club identifiers that may be golf club mounted.

Shown in FIG. 2 are multiple detectors 200, one for each club, each configured to sense an actual swing and/or golf ball strike for the specific type of club, whether it be a driver 218, iron 210, or putter 202, that are each club mounted. Each detector 200 shown is configured to transmit data indicative of a golf ball strike, and/or golf swing characteristics, back to a reading/processing device 306 via link 308, such as display/scoring unit 600, which may be worn by golfer 302, or via link 310 to a remotely located device, such as in a golf cart 314 as shown at 316 in FIG. 3. The data transmitted may be responsive to a signal generated by unit 500, or may be automatically sent without prompting.

In various other preferred embodiments, different points of attachment of the detector 200 may be used, such as next to the club grip and directly onto a club shaft at 208, or within the club shaft itself at 206. The detector can also be mounted near a club head at 204 and 214, such as the club hosel, or internal to the club near point shown at 212. Although FIG. 2 shows different points of attachment on the three clubs represented, the specific points shown may be used on any of the clubs.

During a club swing, the golfer performs a slow backswing of golf club 100 in the direction indicated by 120. At the pinnacle of this action the direction is reversed and with the aid of the body movements the club head is accelerated in the direction indicated by 118. During this action different results may occur. The golf ball 110 may be struck directly, or the ground 114 may be lightly stuck before hitting golf ball 110. Other results such as the ground 114 being stuck in a manner that results in a divot removed at 116 may occur, after which the golf ball 110 may or may not be hit by the club head 108. Additionally, it is conceivable that the golf ball 110 is missed completely by the club head 108.

Regardless of which of the above actions takes place, the club head 108 will continue in some manner in the direction indicated by 112. Due to the amount of variables in the actions resulting from a golf club swing, the speed of a club head, and the similarity from one swing to the next, it is desirable for an automatic golf scorer that is capable of detecting and/or analyzing these variables to provide practical information as well as one that is portable, enabling its use during actual play.

While various approaches may be employed to detect the contact of a golf ball 110 and club head 108, they may be intrusive. Any device mounted or adhered to the face of club head 108 may affect features that are designed into the head to aid in spin and momentum transfer to the golf ball.

Other devices/sensors may mount at an area of the club likely to provide the greatest amount of feedback to a detection device, such as at point 214. Mounting a device in that location may affect the actual swing characteristics of the club itself, potentially altering the swing weight or resistance to the air, or just the fact that the golfer may perceive that such an affect occurs.

Figure 3:
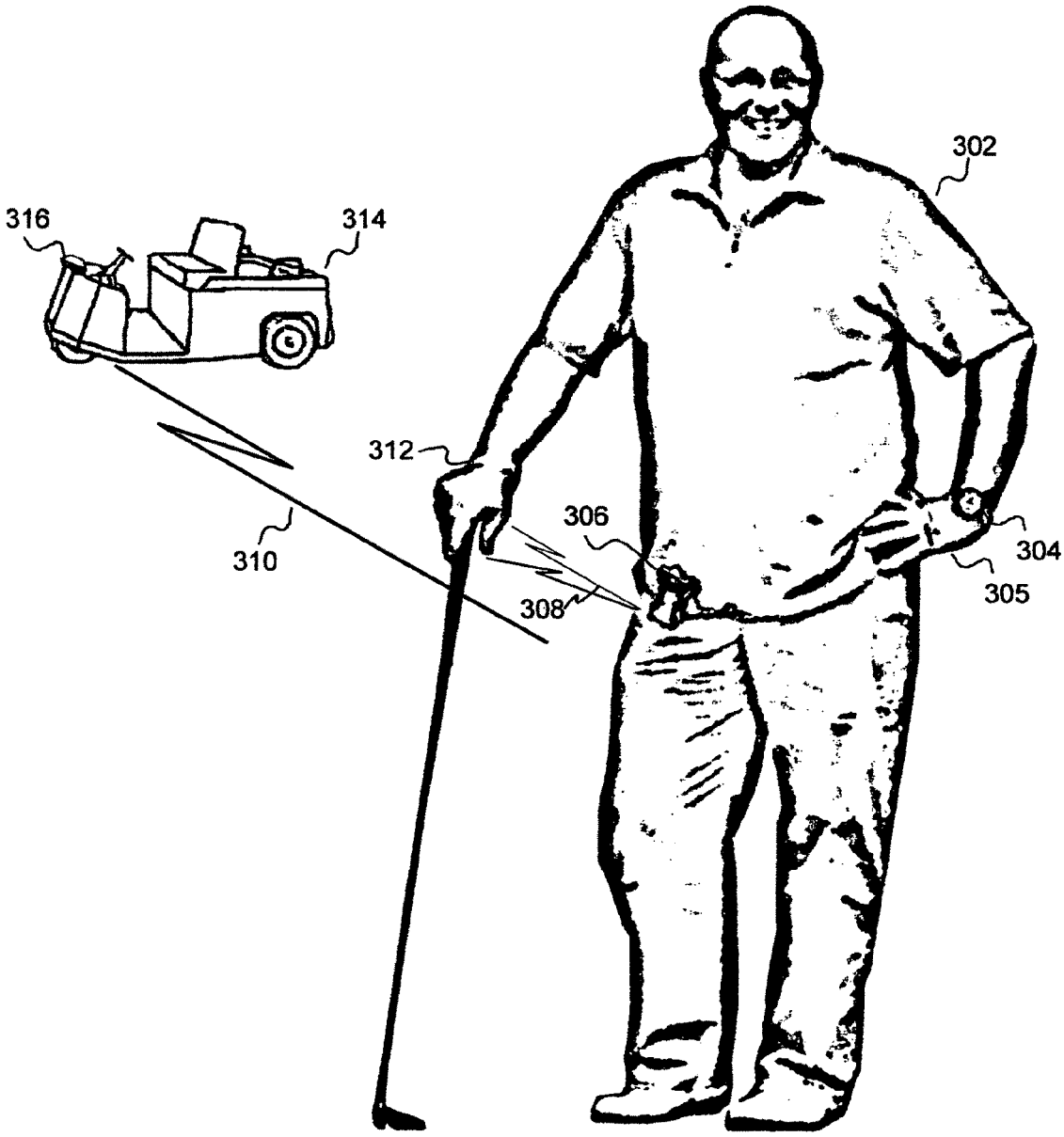
FIG. 3 shows multiple locations a scoring system receiver, and/or scoring system display units that may be worn on the golfer or mounted on a golf cart.

In yet another preferred embodiment, referring to FIG. 3, the detector 200 may be incorporated into/onto a glove of golfer 302 as shown at 305 and described later in reference to 806 and 822 shown in FIG. 8, wrist mounted in a player attachment/accessory 312, or incorporated into a watch 304.

In embodiments where the swing detector 200 is not physically attached to the club, the detector is configured to sense parameters indicative of the club swing and/or an actual ball strike. In a preferred embodiment each club has an ascertainable indicator that is indicative of the club. Identification may be made by reading an RFID code, by sensing a resistance indicative of the club, or some other method.

RFID tags may be designed in many physical configurations. For the above embodiments described wherein the swing detectors are not physically attached to each club, a properly shaped RFID device may be utilized in some of the locations previously discussed with swing detector 200. For example, a small circular RFID tag may be attached at 216, shown in FIG. 2C, or a larger rectangular one may be placed under or near a golf club grip such as at 206.

Figure 4:
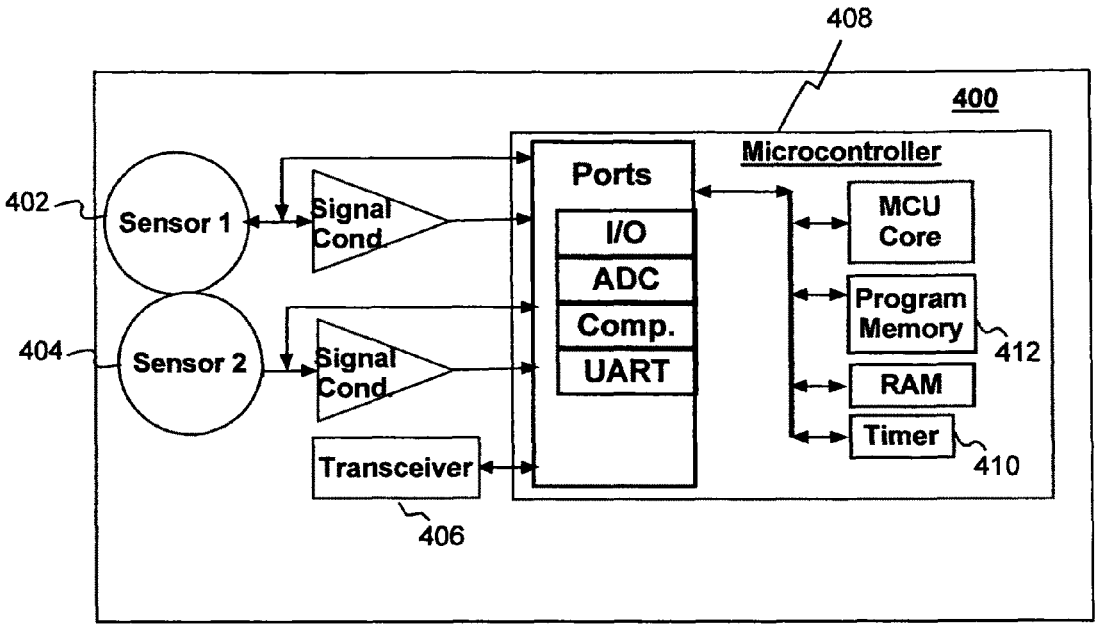
FIG. 4 is a block diagram of one embodiment of a club mounted swing detector.

One embodiment of detector 200 is shown as detector 400 in FIG. 4. This detector 400 may be detachably mounted to clubs. This detector may also be selectively changed from club to club if desired. Shown in FIG. 2 is this detector mounted at 216 onto a driver 218, and at 208 mounted onto an iron 210. Other locations for this embodiment can be at 204 and 214. The detector 400 has a processor, such as a microprocessor, as well as supporting elements including memory and a data interface.

Figure 2B:
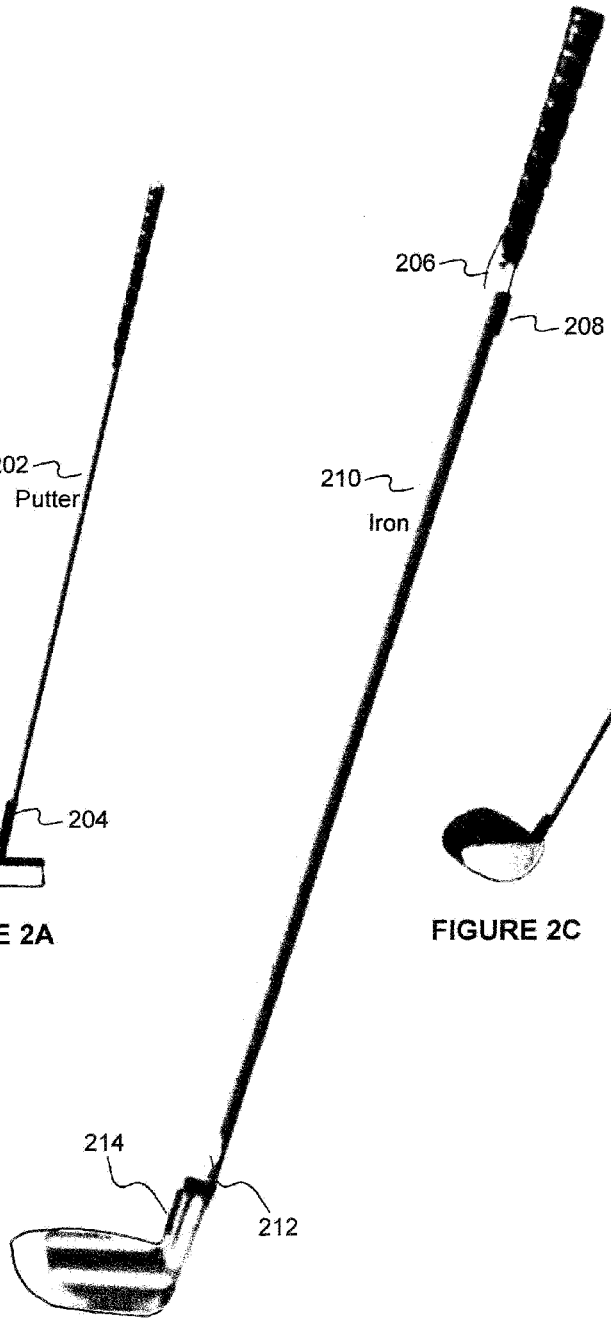
Figure 2C:
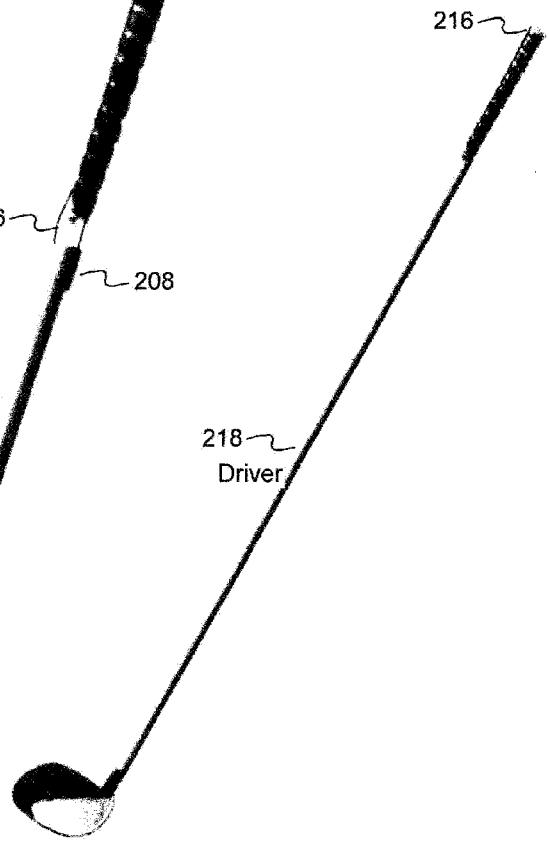

Detector 400 may also be mounted internally at points such as 206 and 212 shown in FIG. 2B on iron 210. It is contemplated that similar mountings and variations may also be used on putter 202 and driver 218.

Dependant on the preferred embodiment, the present invention advantageously detects both the club swing and actual ball hit. Additionally, it differentiates the actions that result in the incrementing of a stroke to the score, from those actions that do not, such as practice swings and divots.

As seen in FIG. 4, one embodiment of detector 200 is shown as detector 400 and may be attached directly to each club. Detector 400 includes a microprocessor 408, such as a Microchip technologies 12F683 or 16F883 configured to evaluate inputs from sensors 1 and 2 (402 and 404, respectfully), where such sensors may be accelerometers detecting positive and negative swing accelerations, and/or club angles, club vibration (such as a vibration frequency), or a step function delta indicative of a ball strike. One of the sensors may be used to provide additional feedback, such as a sound profile of the ball hit itself, or visual or sonic feedback of the golf ball itself.

Also shown in FIG. 4 is a timer 410, wherein the input signals received from the sensors and the timer are analyzed by processor 408 and compared to characteristic profiles stored in memory 412 indicative of many different types of events that may occur. For instance, the time between the initiation of a back swing until a ball strike can be correlated with other input, such as a club type, to determine actual club swing parameters. These club swing parameters are then transmitted back to unit 500 where additional analysis may be performed in real time, or at a later time, such as when the data is downloaded to a PC for later analysis. Transceiver 406 may be part of processor 408 or separate. Transceiver 406 is a low power short range device with a specific identification code and may be of the RF type, Bluetooth, or another transmission method.

Figure 5:
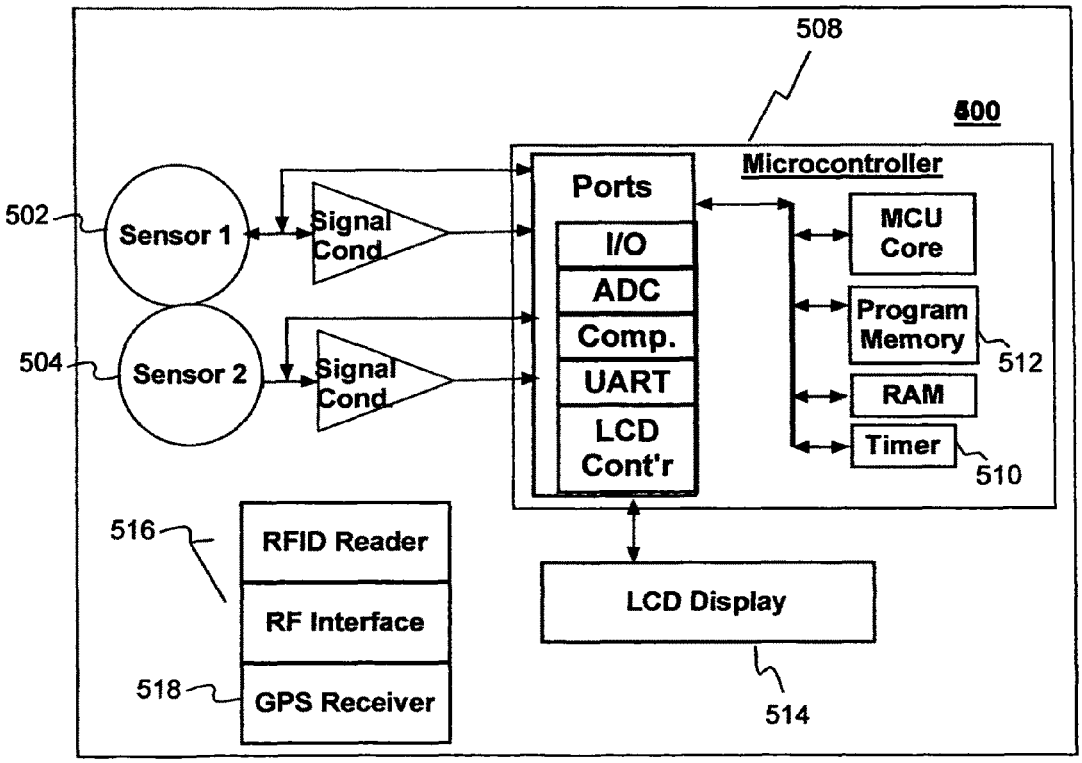
FIG. 5 is a block diagram of a second embodiment for a club mounted swing detector.

FIG. 5 is a block diagram of another embodiment of swing detector 200 shown as detector 500. Microprocessor 508, timer 510, sensors 1 and 2 labeled 502 and 504, respectfully, memory 512, and transmitter 506 may be utilized as described above for detector 400, or in a different configuration. This embodiment is configured to be worn by the golfer as shown in FIG. 3 as 304, 305, or 312. The detector 500 may also have a display 514 shown as 304 configured to generate a visual event indicative of the swing or ball strike. Moreover, the detector 500 may include an RFID interface 516 configured to receive RFID signals from a club, such as indicative of the club used during a swing and ball strike. Aside from an RFID device, an alternative method may be used for identifying each club, such as a resistance discrimination method, wherein each club has a unique resistance characteristic such as in the grip, detectable by golf glove 804 and shown worn by golfer 302 as 305. Additionally, other club identification means could be employed as recognizable by those skilled in the art.

Detector 500 may also include a low power short range device with a specific identification code and may be of the RF type, Bluetooth, or another transmission method to communicate information to a display/scoring unit, such as unit 600 or unit 700, as similarly done in device 400, shown here as an RF interface or wireless interface 516. A GPS receiver 518 may also be incorporated or the transceiver means used to communicate with a separate GPS device.

Figure 6:
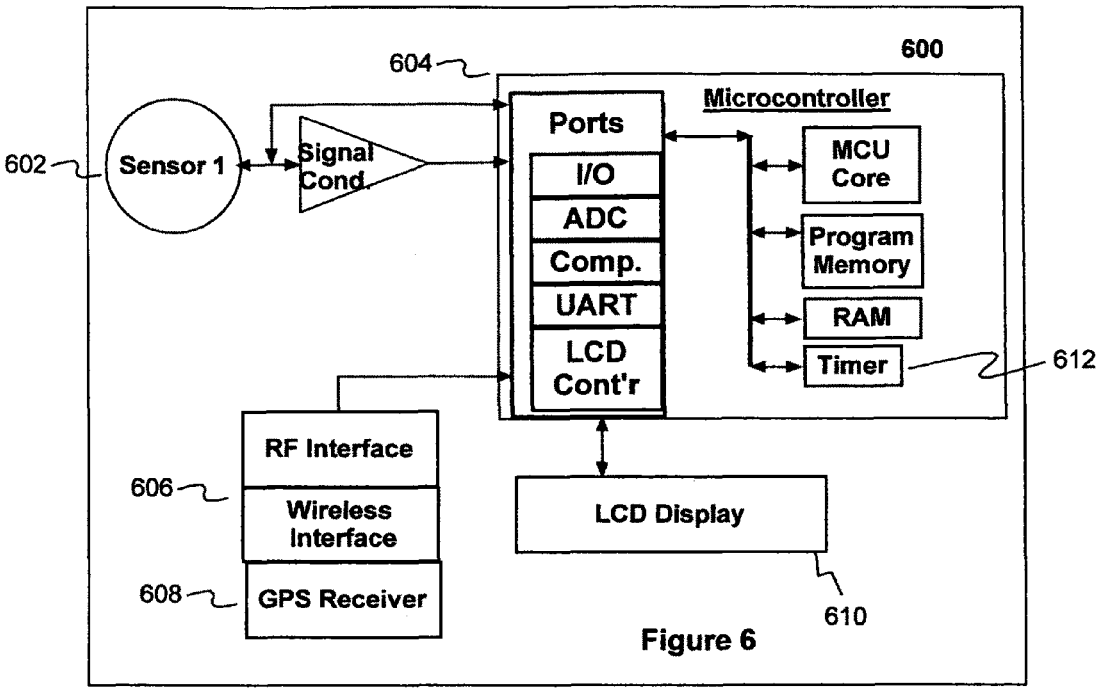
FIG. 6 shows a block diagram of one embodiment of the automatic scoring gaming device.

FIG. 6 is a block diagram of the user worn display/scoring unit 600. This unit partially consists of a microprocessor 604 such as a Microchip Technologies 18F6393, timer 612, and micro display 610. Information/data is received by transceiver 606 from a single club, or even multiple clubs, with embedded detectors. For the embodiments where the clubs do not have these detectors, information may be received from body mounted swing detectors, such as those shown in FIG. 3 at locations 304, 305, or 312. Additionally, a physical contact glove detector may be used as described later in an additional embodiment. The unit 600 receives the data from the user worn glove transceiver/detector, such as that shown in FIG. 8 at location 806 or 822. Due to the many embodiments it is important to understand that a user worn display/scoring unit such as that shown as 304 in FIG. 3 may also incorporate a swing detector, therefore, similarities as well as differences are explained in both the descriptions of units 500 and 600.

Algorithms in processor 604's embedded code perform additional analysis on this information/data. One preferred embodiment incorporates a GPS receiver 608, while another embodiment having at least one sensor 602 determines game scoring by using and/or correlating the profiles and methods outlined in Tables 1 to 3. For example, the length of time between golf club swings, which club was last used, the changing of a club, and vibration data, such as a traveling profile described in Table 3. This data and the method algorithms may be used to determine that one hole is completed and a new hole is being approached and adjust the stroke count appropriately.

Figure 7:
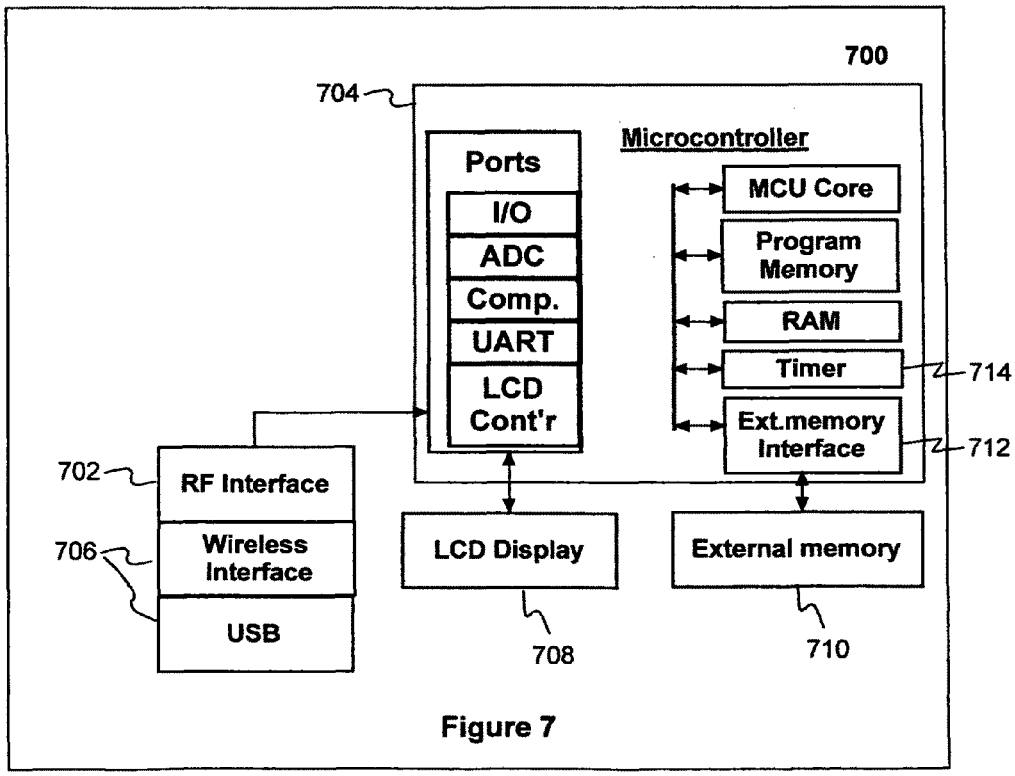
FIG. 7 shows a block diagram of another embodiment of the automatic scoring gaming device.

FIG. 7 is a block diagram of the cart display/scoring unit 700 having at least one system including wireless interfacing, such as an RF interface 702, and may have additional data communication means 706 such as, but not limited to, Bluetooth, Wireless Internet, Cellular, or USB. This unit partially consists of a microprocessor 704 and timer 714 and display 708. Information/data is received by a transceiver/wireless interface 702 in real time from body mounted swing detectors, such as those shown in FIG. 3 at locations 304, 306, or 312.

Transceiver 702 communicates with the multiple swing devices 200 while transceivers 702 and/or 706, additionally, may be used to receive code and profile updates, or download the results stored in unit 306 and 316 to a PC or other devices such as a PDA, in real time via a data link, or at a later user defined time. Using transceivers in place of transmitters allows for additional functionality. For example, the individual profiles and sensor characteristics can be updated, or swing device data communication could initiated by request or polling, such as initiated by remote display/scoring unit 306 or 316. Such improvements may result in longer life to batteries in sensor 200, not shown in these diagrams.

FIG. 7 also shows an embodiment where additional memory may be included. This memory can be interfaced to directly from an integrated memory controller 710 contained within a microcontroller, such as a Microchip technology PIC 18F8493. An advantage of this embodiment is that wireless data may be communicated amongst other teams such as in a tournament play. Additional memory also allows multiple players to have ready access to a great amount of historical play information previously obtained by the automatic analysis system being described herein. An instance of such data may be a data screen selection displaying information on selecting your golf club based on an analysis of the distance required and the average distance hit with various clubs that day and/or historically. An additional use may be to select a screen display that provides recommended changes to your golf swing based on how you are hitting the ball that particular day (e.g. you are slicing to the right, please try to do . . . , your acceleration is too slow, try picking up golf speed, etc.)

Advantageously, the display/scoring units described herein as units 304,306, 316, 600, and 700, release the user of the burden or trying to remember a lot of details during game play, but can rather rely on the data now immediately available to make adjustments to one's game play during the game. Frustration is reduced because a golfer does not have to wait until the next game to consider how to improve one's game. By knowing that one is hitting the 7 iron well, for instance, one may choose that club over a 6 iron if one knows that he/she is hitting it better.

Figure 8B:
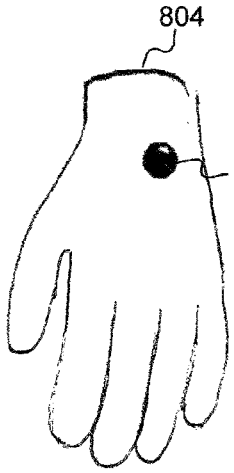
FIG. 8 shows representations of a golf glove, and a golf club grip, wherein data information transfer occurs through physical proximity or contact, and a showing how power may be supplied to devices resident with-in the golf club.
Figure 8A:
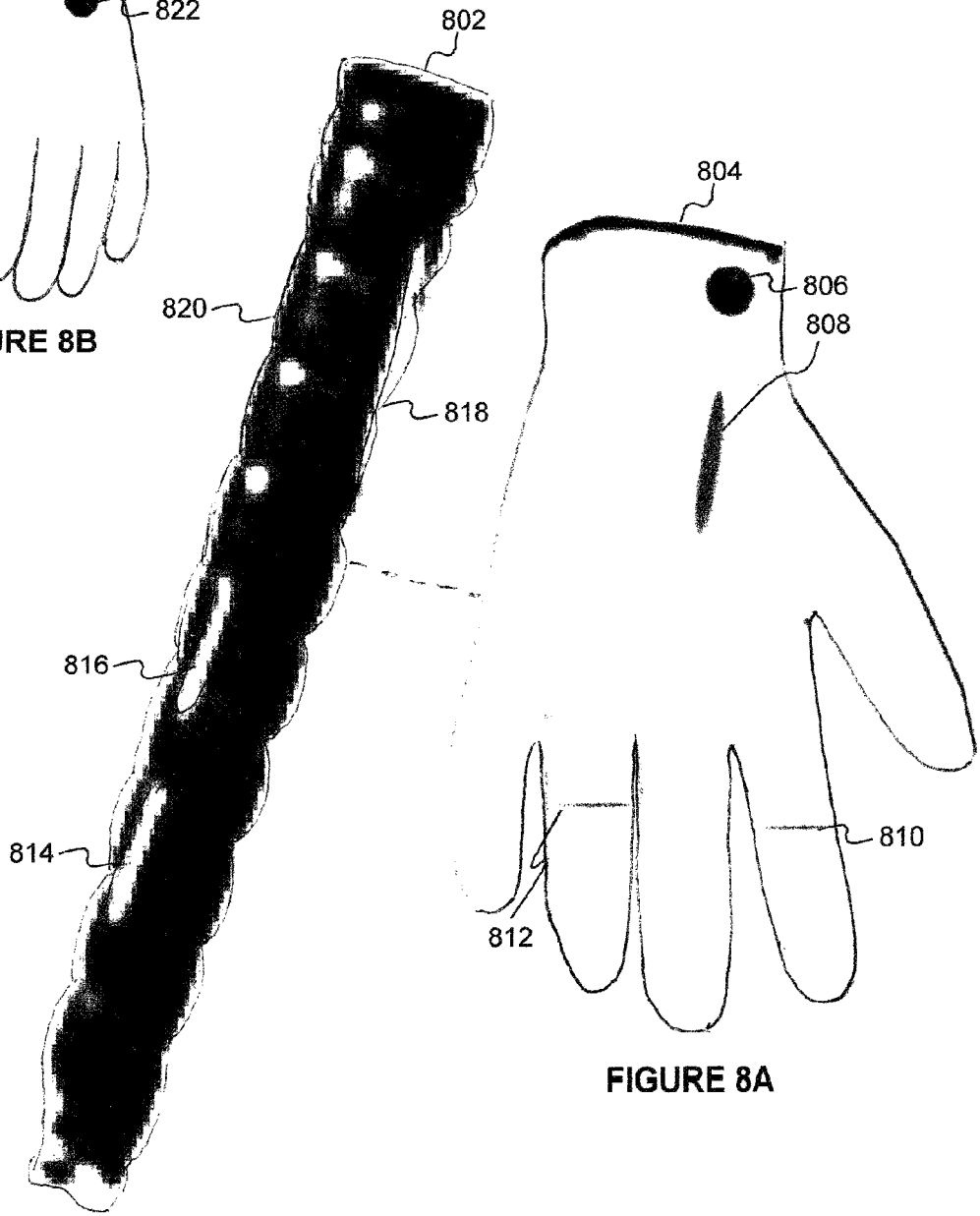

As shown in FIG. 8, the user worn glove includes a detector configured to read/ascertain data indicative of the club used, and transmit or render available, this data to a remote device such as unit 306 or 316, or any other data unit as desired. The advantage of this embodiment is that an active sensor or passive sensor can be placed on or within the club, which may be cheaper. This embodiment may not include an accelerometer, and may simply just count shots on each hole and the total for the round, or may also provide useful data during actual game play for consideration by the golfer prior to the next shot, or set of shots.

Figure 9:
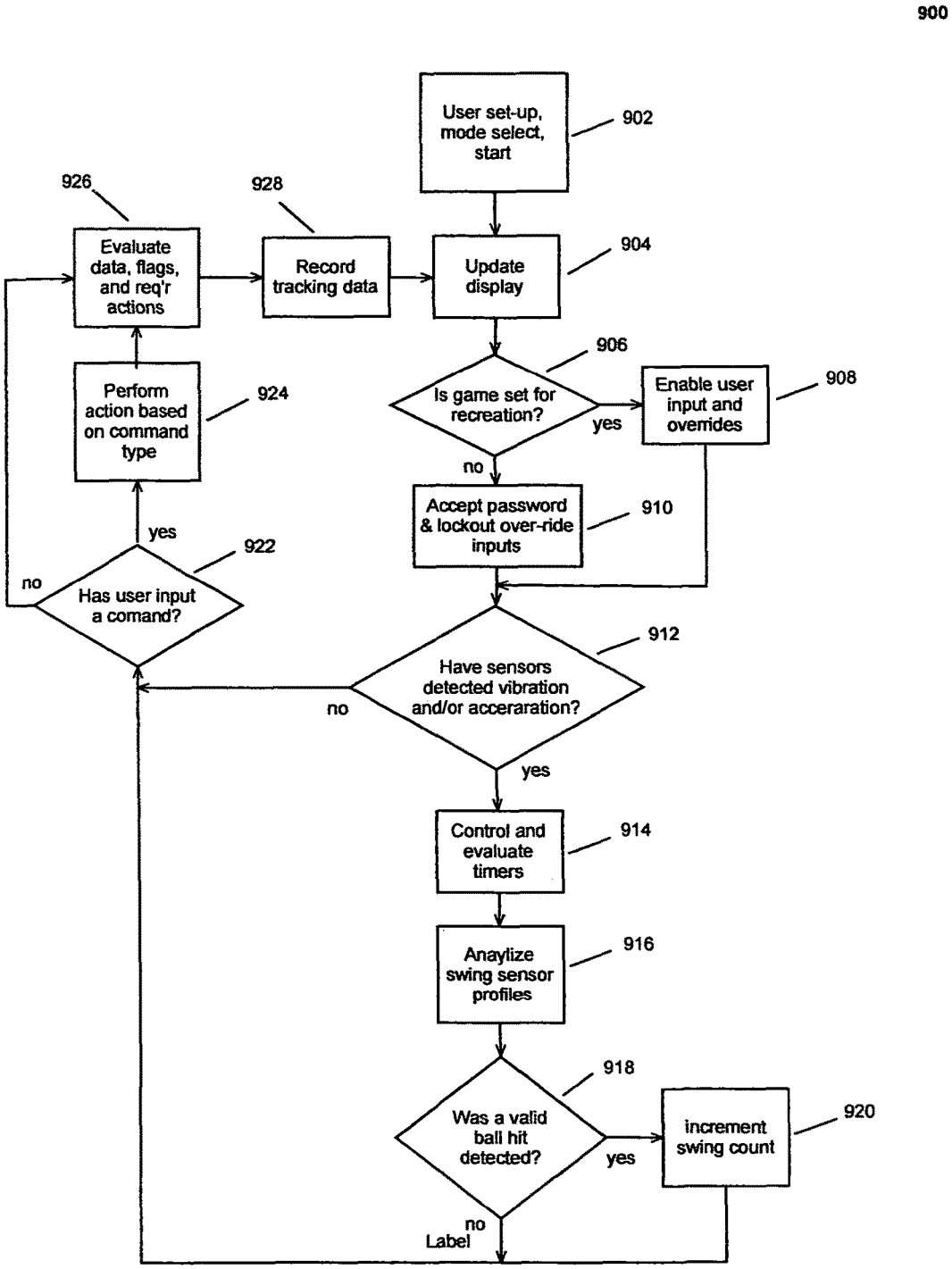
FIG. 9 is a flow diagram of the automated scoring system according to one embodiment of the invention.

FIG. 9 is a flow diagram of the processing steps that may taken by the display/scoring unit 306 and 316 in conjunction with a single swing detector of type 200, during a normal round of golf. As shown at step 902 the system is initialized, set to the desired mode, and started.

When the scoring unit resets during power-up, or is reset by a player, it remains in a standby state awaiting a user's input. Internal flags are initialized and sensor inputs are disabled until a player initiates the start of a game. The player may select a game, or to download stored information to a PDA, or other additional functionality. The display is updated at 904 and the player is queried as to the type of mode desired. During recreational games 906, the user is allowed to modify the stoke count determined by the automatic scoring system 908. Other rounds, such as those during a high school competition, could be set to lock out any user input that affects the score 910. Additionally, this data may be broadcast in real time, or delayed, to a central location, such as a server, to obtain and display multiple player data for analysis or review.

In one embodiment unit 306 or 316 will now wait for input from a swing device 200. Upon receiving input from the device, the state flow for the display/scoring by-passes step 912 and continues to 922. When sensor device 200 detects motion at step 912, the processor evaluates and performs data storage and calculations at step 914. When a valid profile that affects unit 306 or 316 is detected this information is transmitted to it. If the transmitted information and the data within unit 306 or 316 determine that a shot was taken at step 918, the shot count is incremented at 920.

Step 922 looks to see if a user input has occurred. The actions that may result from an input are determined at step 924. If the mode is recreational the score can be adjusted. In all cases a user can flag an event for analysis, of the processed data, at a later time. For example, if a player did not agree with the scoring of a hole he could flag that hole. The inputs to, and the decisions made by the swing counter, as well as the scoring unit could later be reviewed.

The scoring display unit 306 and 316 as well as the swing device 200 will continually be re-establishing a new current state and determining how it may affect the next action. This occurs at step 926. Finally, all raw data is stored during step 928 and the process continues.

It is important to remember that the real time loop presented in this flow diagram occurs repeatedly at microprocessor speeds. The states shown on this diagram are simplified to facilitate the explanation and teaching of this invention. It will be recognized by one skilled in the art that methods and process steps can be altered to occur in a different order or even simultaneously, such as an internal counter routine updating status variables or data calculations caused by timer interrupts to the processor.

A GPS receiver coupled to, or integrated with, the above swing detection system, such as the user worn display/scoring unit, further enhances the present invention by providing ball location and golf hole data correlated to the data obtained, such game play and swing analysis.

The GPS receiver gathers information from multiple satellites. With this information, the invention can accurately determine the receiver's location during golf play. The GPS receiver is designed to communicate with processing devices in a NMEA2.1 or similar protocol. Information about the receiver's longitude, latitude, altitude, and time aid the invention in providing the golfer the ultimate of real time and post play analysis.

When the GPS unit is utilized in one preferred embodiment, the cause-and-effect relationship of a golf shot, swing profile, club, course, and other conditions can clearly be correlated, tracked and presented in a graphical and easy to interpret display, in real time in units 500 and 600, or stored for post game analysis.

Graphical interfaces, and even animated interfaces, prove to surpass the learning traditionally obtained within a control facility, or environment, as well as greatly enhance the game enjoyment.

For an example, using the display device 306 or 316, or a remote PC/PDA with downloaded data there from, during post-analysis, a golfer can pull up information about a round that has been played. By zooming in, any particular hole may be selected, or a screen button can be clicked. The player can choose other options to learn about prior performance on a given course or hole, and can add notes. Data can also be shared between users of various automatic scoring systems equipped with a wireless interface such as that shown in device 600, or even uploaded to other sites, such as via the internet for further analysis, scoring and processing.

Figure 10:
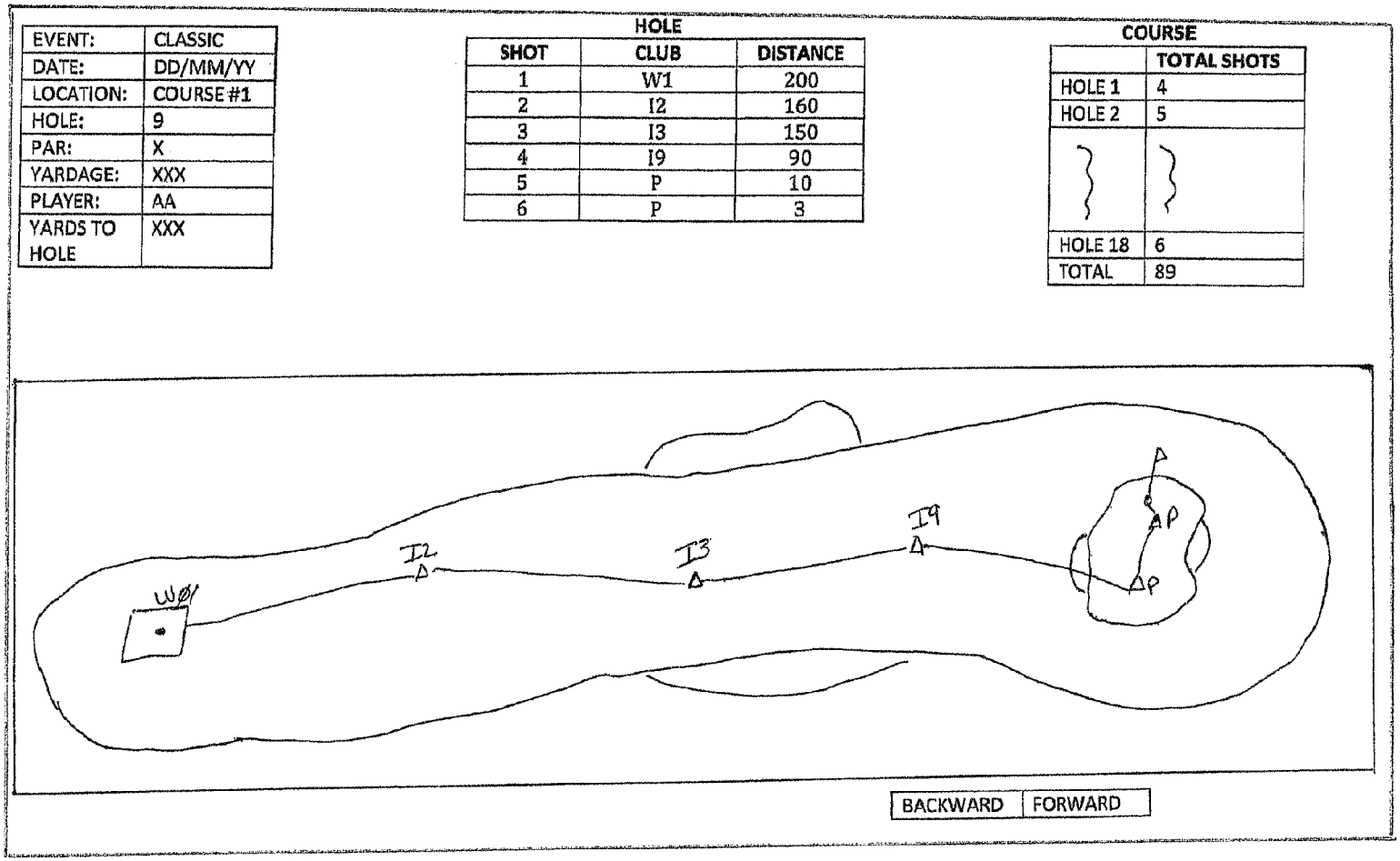

Now looking at FIGS. 10A and 10B there is shown one display that may be visually rendered by unit 306 or 316 during play. Understanding that unit 306 may be an embodiment that only allows for alpha-numeric type information, such as that displayed on a micro-display, the information presented in FIG. 10A is representative; however, the displayed unit may be such as a PDA. In such a case the information is presented both in FIG. 10A and FIG. 10B may be displayed. The visual display may include actual game specific information, including shots taken, club used, distance of each shot, hole information, course information, date, and other statistics valuable to the golfer, in real time, during the actual play of the game. This information can be used by the golfer in determining one or more future shots on the same hole, or a future hole. The user can scroll backwards and forward between individual holes to consider play during the actual game. For instance, while playing hole 10, the user can scroll back to the display showing the play for hole 7 to ascertain the club and distance parameter and use this information to determine which club to play at a given location on hole 10. As a course is played more frequently additional information you need in completing a more detailed pictorial is obtained. By having this information a golfer can more easily visualize what a given hole that was played like. Hazards, doglegs, and other information may provide feedback and why a particular club which chosen and why the distance with this club may be significantly different than when this club was used on a different hole.

FIG. 11 shows a display in another format, which renders current game information, such as club performance/results during the current game. For instance, the player can appreciate the average distance of a shot as a function of the club. The results can even be weighted or selectively removed/edited so one can appreciate relevant information.

Figure 12:
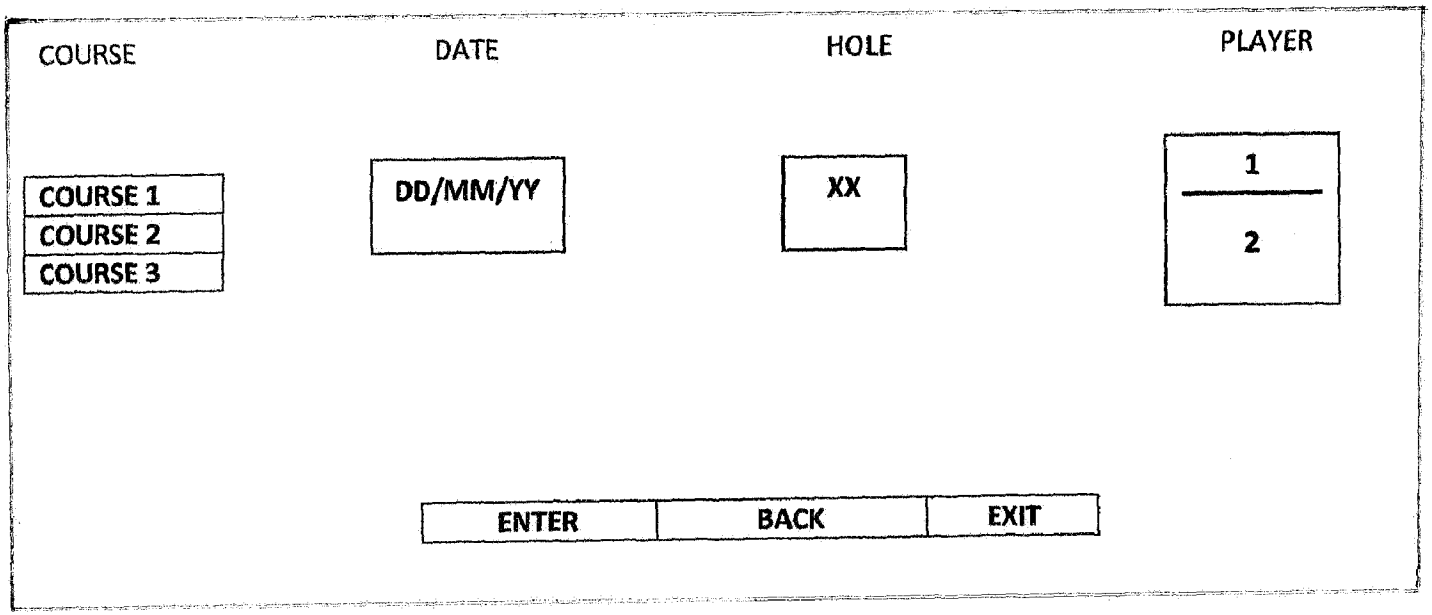

FIG. 12 shows a menu option so a golfer can, during game play, see and consider how he/she played the hole on a previous occasion. For instance, the player can select a desired course, the date played, and the hole played, and hit enter. The stored information for this entered data will then be displayed. Advantageously, the golfer can appreciate data from previous actual play on the same course or a different course, the same hole or a different hole.

Now looking at FIGS. 13A, 13B, 13C, 14A, 14B, and 14C there is shown the various club and body positions that occur and can be detected and/or analyzed by detector 200 throughout the action of a typical golf swing. This is accomplished by a combination of analog and/or digital filtering, time profiling, and the effect of a shot as observed by the location of the ball's final landing place. Once again, referring to two distinctively different embodiments; that of utilizing a GPS receiver, and that of accomplishing similar informational data without the cost or benefit of a GPS receiver, these various embodiments are summarized in tables 1 to 3. To some, golf is a lifetime pursuit of perfection, while to others it is an afternoon in the sun. Therefore, much consideration has been given into how to teach multiple embodiments that reflect various market and product decisions.

Depending on the embodiment, an ordinary skilled engineer may incorporate one of several implementations presented here as well as others enlightened by these teachings.

Let us first look at the various events detected by, the various embodiments disclosed:

A simple ball strike;

a practice swing versus a whiff;

a divot continuing into a ball strike;

a sand trap ball hit at the top.

While the simple ball hit may be basically shock detection, a more sophisticated algorithm is employed to distinguish this from the other above mentioned.

One may consider a swing profile analysis as a more complex action than the aforementioned, and this is not the case when implementing all of these features. A profile analysis of the swing essentially deals with the acceleration or velocity, depending on one's viewpoint of the swing. Also taken into account is the relative position of the club in the x, y, z planes throughout the profile.

Some of the desired information in swing analysis include but is not limited to backswing velocity;

swing arc;

club swing acceleration;

club follow-through.

One should take note that the items mentioned here essentially are referring to the detection on the club or near the club, such as the golfer's wrist. Also, as clearly seen in FIGS. 13 and 14, the specifics of the golfer's body position are not clearly addressed by the sensors located in one or both of those regions.

An occasional recreational golfer may simply require the convenience of an automatic scoring device. Improving golfers are likely to be interested in correcting and consistently reproducing a correct swing profile.

Table 1 is a tabular summary of various profiles that are analyzed during a round of golf. These profiles are used to determine/correlate a relationship between the golfer, elapsed time, and input from the various sensors. With this information, according to one embodiment explained later on, the invention may simply keep automatic score of a golf round. When other sensors are utilized, the invention allows one to track, show or render the ability/actual play, advantageously providing more meaningful, detailed, real-time information about one's performance.

Table 2 shows various profiles described, such as backswing or RFID read. The profile used will be dependent on the embodiment being implemented. Depending on the implementation, as shown in Table 2, there is another way of looking at how to determine that a golf shot was taken.

Table 3 complements Table 2 in that it provides a brief description of the methods that are used with the various device combinations to achieve these profiles.

Figure 13A:
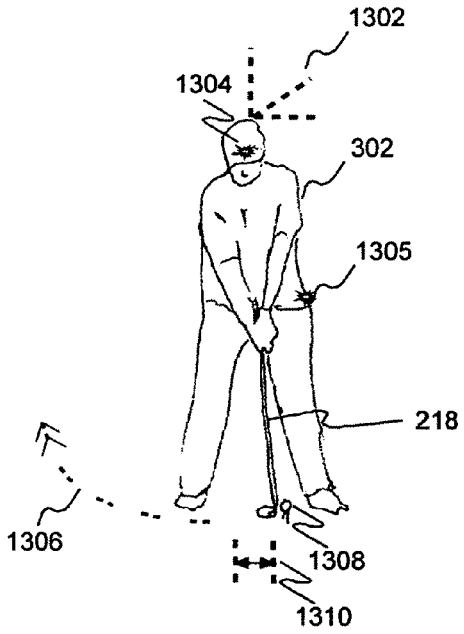
FIGS. 13A, 13B, 13C, 14A, 14B, and 14C depict the various club positions during a typical golf swing, with various locations of additional sensors providing real-time feedback of the various body positions effecting the outcome of a shot.

Again referring to FIGS. 13A, 13B, and 13C one can observe the various positions throughout a typical golf backswing. Shown in these figures is a typical golfer 302 performing a swing using driver 218. FIG. 13A shows a unit 200 configured to be worn on a hat or hatband with the detector located on the forehead. Additional sensors of this type may be worn in various other player locations such as on a belt to detect hip and body shifting throughout the swing. Sensors of this type may be attached in a multitude of means, such as but not limited to clip attachments, band attachment, and clothing with sensor integration.

Shown in FIG. 13 is a slight movement of golf club 218 at or near golf ball 1308, shown at location 1310. In table 3 this is a method described as club swing: aim alignment. The data is collected from swing detectors 200 located on or in golf club 218, and is coordinated with body worn detectors at locations 1304, 1305, and/or all the locations on which the golfer chooses to place them. This data may be used to analyze both the effects of the club swing profiles summarized in table 1 such as of club swing: aim alignment 1310, club swing: backswing 1306; as well as those effects introduced by the body movements themselves. Combined with time and analysis, the golfer is provided with information vital to identify the golfer's individual play characteristics and therefore rapidly aid in the improvement of his/her play. Examples of such information are backswing velocity, the lifting of one's head just prior to the shot, the body positional alignment in its relationship towards the flag and hole on the golf green.

In FIG. 13A the x, y, z positional coordinates shown at 1302 reflect those of the golfer's head throughout his swing, depicted in all FIGS. 13A through 14C. Of particular importance is the timing when a head position changes from viewing the golf ball at location 1310 to watching its flight at the time of the swing completion 1416 in FIG. 14C.

Figure 13B:
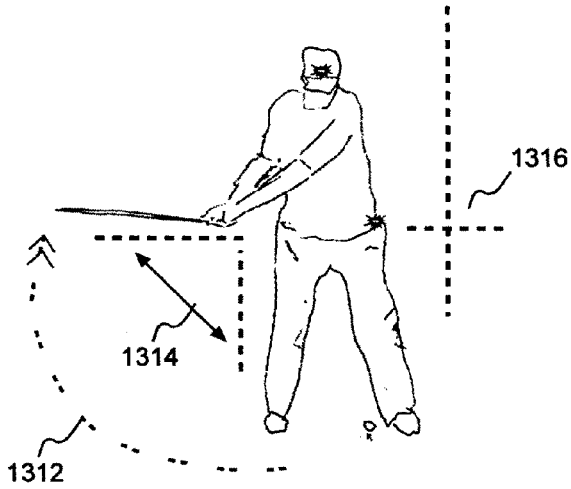
Figure 13C:
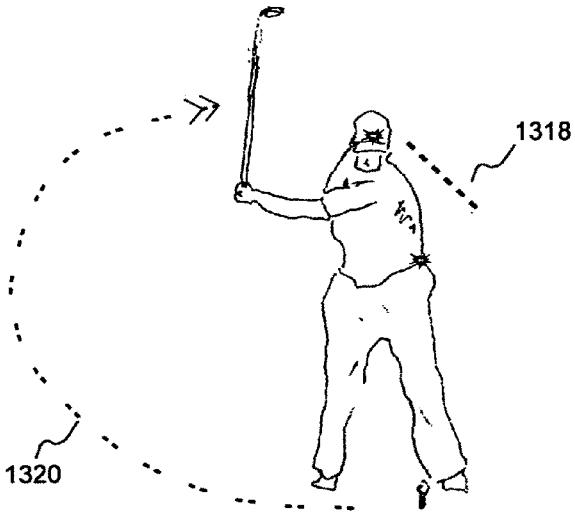

In FIGS. 13A to 13C, the total backswing path is represented in stages shown starting as 1306, continuing through 1312, and reaching its peak at 1320. The club angle change with respect to the vertical is shown as 1314, while the body potion shift is shown as 1316, and a final change in shoulder angle with respect to the horizontal ground plane at 1318.

As shown in FIG. 13 the effects on the flight of golf ball 1308 from the club swing profile are primarily sensed and analyzed from club mounted detector 200s during the path as shown by 1306, 1312, 1320. The body's influences are shown here as 1302, 1316, 1318. Without the benefit of time analysis and the benefit of the landing position of the ball, the instructional aid is diminished, while for a casual golfer this information may still be adequate.

Figure 14A:
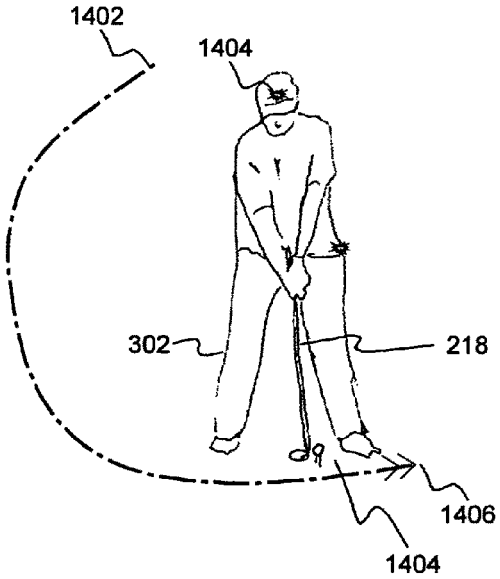
Figure 14B:
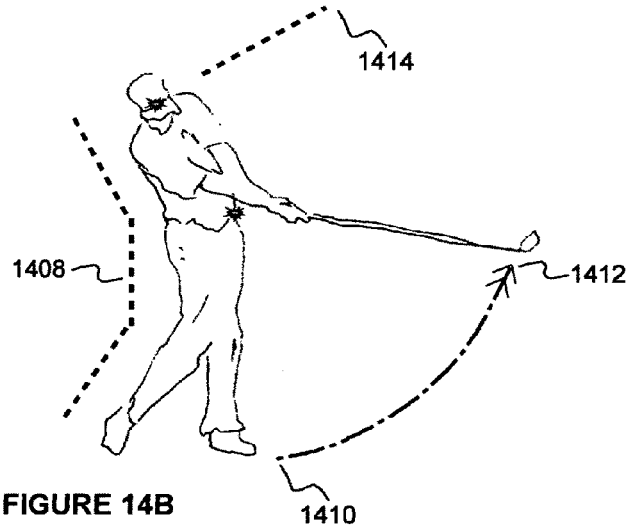
Figure 14C:
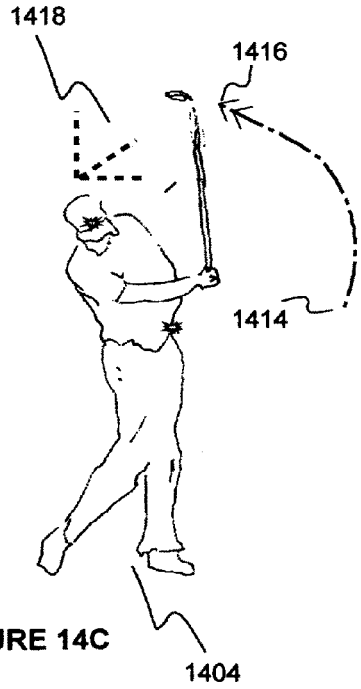

FIGS. 14A to 14C show the forward swing continuation. Here distinct locations of the swing are called out such as the combination of 1402, followed by 1406; continuing 1410 to 1412, and 1414 to the completion of the swing at 1416. These points, as well as those that similarly occur within the swing paths shown in FIG. 13, indicate approximations of data collection times based on device 200 sensor input that is used during time/event profiling when a club is swung.

According to the various embodiments of this invention, this data can be obtained by the sensors 200 in real time.

Data Protocol Transfers

Dependant on the embodiment, either the display gaming device or the swing analyzer can initiate the start of data collection by the swing analyzer. The display gaming device may send a start request to the swing analyzer, and the swing analyzer then begins collecting data for analysis against desired profiles. When the swing analyzer determines that a profile has occurred, it transmits data back to the game display device.

Swing analyzer data transfer is both time and event tagged. Data logging is maintained in an efficient manner, so for example, if the golfer has taken practice swings but no ball hit was detected that data could be marked for over-write. In the swing analyzer, the RAM memory used to collect raw data is treated as a stack, wherein when the last memory location allocated for data storage is reached, the pointer is reset to the first location. If a protection flag is set it proceeds to the head of the next set of data.

Data transfer to the display unit may be either just specifically requested information, or a complete transfer of all raw data. Each time data is transferred via RF, power is consumed therefore transfers are kept minimal In one embodiment, what is transferred is only the pertinent information. For instance, a ball hit has occurred in a mode selected to only keep score. In another embodiment, such as where analysis is performed, the pertinent sensor data is transferred with the time tag and the event tag. The analysis of this information is then correlated to one of the profiles discussed in table 1 to 3.

At times a request for all raw data may be made for later analysis. In such a case all of the time and event tags along with their sensor values are transferred. Collecting this amount of raw data requires an implementation using sufficient memory to allow for 18 or more holes.

One protocol transfer sequence may look like this:

Here, time is expressed in milliseconds while accelerometer x, y, z axis angle and acceleration are expressed as voltages.

| Club ID/ Protect and error flag | Time | Latitude | Longitude | X axis accel | Y axis accel. | Z axis accel. |
|---|---|---|---|---|---|---|

| Event Tag/ Protect and error flag | Time Delta | X axis angle | X axis accel. | Y axis angle | Y axis accel. | Z axis angle | Z axis accel. |
|---|---|---|---|---|---|---|---|

Monolithic IC Accelerometers, such as an Analog Devices ATXL 330, can work in both static and dynamic acceleration modes. A static acceleration of gravity is used in tilt sensing applications. A dynamic acceleration is a result of motion, shock, or vibration. Accelerometers of these type may prove advantages in one preferred embodiment. As seen in FIG. 4, sensor input may be applied directly to a processor I/O, may be conditioned and then applied, or may be used as two inputs proving isolation to allow for different filtering to take place out of the same accelerometer.

Additionally, accelerometers are chosen as one to three axis allowing for different levels of maximum g's. A user selects the bandwidth of an accelerometer using external capacitors on each X, Y, or Z. axis. Depending on the model of accelerometer chosen each axis may differ in available bandwidth. For example, on a ATXL 330 device, the X and Y axis allow a range of 0.5 Hz to 1600 Hz, while the Z axis is limited to 0.5 Hz to 550 Hz. Conforming to: $F_{-3\ db}=1/(2\ pi(32\ k)\times C_{(x,y,z)}$ Additionally advantages for this device is its low power consumption and its ability to run from a single supply ranging from 1.8 V. to 3.6 V. to accomplish this the signal outputs are ratio metric. One must however be aware that while the output sensitivity varies proportionally to the supply voltage the output noise is absolute in volts. Or stated another way as the supply voltage increases the noise density decreases: rms Noise=Noise Density×(BW×1.6.)

While the low power consumption of these devices makes them ideal for this application, one must be sure to take into account these noise considerations due to the extremely low mV levels being dealt with during calculations.

First Embodiment

Accordingly to a first embodiment, a swing detection device, such as an accelerometer and processor may be coupled to each golf club in a set of clubs. The user wears a game module configured to communicate and process data from the swing detector during an actual golf shot. A game module includes software, as well as a GPS unit, whereby the accelerometer data as well as the club used can be stored as a function of the golfer location provided by the GPS unit, including hole information and golf course information. The accelerometer can detect the shock of a ball strike, wherein the computer module is configured to use this data to distinguish an actual ball hit from a divot. Automatic scoring can be provided along with GPS location coordinates and the golf club used. The computer module may include a micro display.

Second Embodiment

Accordingly to a second embodiment, a swing detection device, such as an accelerometer and processor may be incorporated into a glove or as a wrist device. Each golf club is uniquely identified utilizing a device such as an RFID tag that may be passive or active as desired. In this embodiment the game module would excite the RF tag while in close proximity to it to determine the club used. Upon the event in which a player may switch clubs the processing of data would allow for correctly identifying which club was actually used last when the ball was struck. A game module includes software, as well as a GPS unit, whereby the accelerometer data as well as the club used can be stored as a function of the golfer location provided by the GPS unit, including hole information and golf course information. The accelerometer can detect the shock of a ball strike, wherein the computer module is configured to use this data to distinguish an actual ball hit from a divot. Automatic scoring can be provided along with GPS location coordinates and the golf club used. The computer module may include a micro display.

Third Embodiment

Accordingly to a third embodiment, a swing detection device, such as an accelerometer and processor unit may be coupled to each golf club in a set of clubs. The user wears a communication module configured to communicate and process data from the swing detector during an actual golf shot. A separate module includes software, as well as a GPS unit. This module may be a unit such as a properly configured GPS unit located in a golf cart. Additionally this unit may be a simple PDF type device or cell phone wherein simplified performance data can be collected and stored for real time or post analysis.

Four Embodiment

Accordingly to a fourth embodiment, a simplified shock detection device along with and modified RFID sensor may be utilized. In this embodiment a game module with query the sensor. The capability would be such that a stroke would be counted for a sufficient level of shock that results from a club striking a golf ball. The game module would have the capability to determine that a shot was performed, recorded the golf club used, and reset the shock detection device.

Fifth Embodiment

Accordingly to a fifth embodiment, the user wears a swing detection device configured to communicate and process data from the swing detector during an actual golf shot. The data obtained from this device provides additional analysis information when coupled to an embodiment one, two, or three.

TABLE 1

Profiles Summary

| PROFILES | GPS | Accelerometer | Club mounted sensor |
|---|---|---|---|
| Ball Strike | | | |
| 1. Time/club profile delta | Req'r | | Any Club used sensor |
| 2. Momentum transfer | | Req'r | |
| 3. Swing angle delta | | Req'r | |
| 4. Sound pattern determination | | | Microphone |
| Club Used | | | |
| 1. RFID read | | | RFID Tag |
| 2. RF transfer | | | Accelerometer or microphone |
| 3. Grip transfer | | | Resistive or microphone |
| Club swing | | | |
| 1. Backswing | | Req'r | Club used or accelerometer |
| 2. Follow-through | | Req'r | Club used or accelerometer |
| 3. Aim alignment | | Req'r | Club used or accelerometer |
| 4. Swing angle | | Req'r | Club used or accelerometer |
| Accelerometer | | | |
| 1. Vibration | | Req'r | Club used or accelerometer |
| 2. Directional plane | | Req'r | Club used or accelerometer |
| 3. Swing angle | | Req'r | Club used or accelerometer |
| Traveling | | | |
| 1. Riding | Each of these profiles is dependent on these sensor combinations chosen above. The requirements will be described in detail in the various embodiments. | | |
| 2. Walking | | | |
| 3. Waiting | | | |
| 4. Watching | | | |

TABLE 2

| Devices Summary | | | |
|---|---|---|---|
| Device | Purpose | Location | Used with |
| Scoring display device | The basic purpose of this device is to automatically keep one's golf score. Dependent on the embodiment and the other devices utilized, this device can range from automatically counting the shots to providing the data for a complete swing and body position analysis for each swing and club used in active play. | This device may be located on a golf cart, worn like a watch, integrated into a golf glove, clipped onto ones belt, or be an application within a PDA or cell phone. | One embodiment requires only a ball strike detector to automatically count strokes. Additional embodiments incorporate or integrate a swing detector. By adding a club ID means and GPS receiver a golfer can easily analyze how he has performed throughout play on a particular course using his various clubs. Additionally, various sensors may be worn to provide information on how his body position throughout the swing affected each shots outcome. An example of such a sensor would be a head position sensor. |
| Swing detector | In one embodiment a profiling algorithm is used to determine a swing and hit of a golf ball has occurred. Another embodiment will capture swing specific data used for later analysis for improving one's game. | This may be worn on the wrist, be part of a golf glove, or integrated into each golf club. | The swing detector will need to be part of or used with a scoring display device. When physically separate from the automatic scoring device a means such as IR, RF, or Bluetooth communications providing for the transfer of data to the scoring device must be incorporated. When used in embodiments providing play analysis a means for obtaining the club ID information must incorporated. |
| Ball strike detector | In one embodiment no information is provided about the swing itself, only that a golf ball was hit. Another embodiment may choose to incorporate this detector along with the swing detector. | The ball strike detector will be located within each golf club | A means to convey this information directly or indirectly to the automatic scorer display device must be provided for. |
| Club ID | In order to provide meaningful analysis, information identifying what club was used during each swing, and where the ball landed as a result of that swing is required. | In all embodiments the device that provides this identification must be physically attached to each golf club. | A means to convey the club used information must be provided for between each golf club and either the swing detector or the automatic scoring device. |
| GPS receiver | Provides information on the location of the golfer throughout the game play. For play analysis the GPS receiver specifically records where each shot was taken from relative to the hole. This information is also used to produce the cause effect analysis of each shot on a specific golf course, each time the golfer hits a ball. | Must be physically worn by the golfer. | This will always be used with some combination of the above mentioned devices. |
| Body positions sensors | This section to be completed later. | | |

TABLE 3

| Methods Overview | | |
|---|---|---|
| Profile Provided For | Devices Used | Method Description |
| Ball Strike | | |
| 1. Time/club profile delta | Scoring display unit with integrated GPS, and RFID reader. RFID tagged clubs. | As a golfer grips a club an event profiling starts that determines the time the club is held, what club it is, time elapsed between different club handling, and GPS location changes; with and without a club handling. |
| 2. Momentum transfer | Scoring display unit with integrated club swing detector. | X, Y, Z, axis accelerometer provides information to a microprocessor that determines a step function delta has occurred that is characteristic of a golf ball hit. |
| 3. Swing angle delta | Scoring display unit with integrated club swing detector. | X, Y, Z, axis accelerometer provides information to a microprocessor that determines a club has been swung showing an angle profile change along one or more axis determined to indicate a club swing. |

TABLE 3-continued

| Methods Overview | | |
|---|---|---|
| Profile Provided For | Devices Used | Method Description |
| 4. Sound pattern determination | Scoring display unit. Golf clubs with ball strike microphone sensor and RF transceiver, or direct grip contacts. | The microphone internal and near the head of a golf club profiles a sound pattern indicating the golf ball strike. Stroke count information is transferred to the scoring unit by low power RF transceivers or direct grip. |
| Club Used | | |
| 1. RFID read | The scoring display unit (if worn by the golfer) or swing detector is equipped with an RFID reader and RFID tagged golf clubs. | When a golf club is within close proximity, for example several inches to a scoring unit or swing detector this unit will excite the RF ID tag providing club specific information. |
| 2. RF transfer | RF transceivers | These units may be in several places, depending on the application they be located in each golf club, if equipped with accelerometers; in any embodiment of a gaming unit, or in a body worn swing detector. Depending on the embodiment the communication may be taking place between any of these devices. |
| 3. Grip transfer | Physical direct contact between a specialized golf glove and the club. | For the purpose of identifying the golf club with the most typical embodiment being resistive identification. |
| Club swing | | |
| 1. Backswing<br>2. Follow-through<br>3. Aim alignment<br>4. Swing angle | Accelerometers either club mounted or body worn by used in all of these profiled events. | Time and angle, or time and X, Y, Z accelerometer axis information and calculations are used or determining these profiles. |
| Accelerometer | | |
| 1. Vibration<br>2. Directional plane<br>3. Swing angle | Accelerometers either club mounted or body worn by used in all of these profiled events. | The accelerometers may be used to determine that a swing has occurred, a ball has been struck, travel is occurring, or in the analysis of the players swing. |
| Traveling | | |
| 1. Riding<br>2. Walking<br>3. Waiting<br>4. Watching | Accelerometers either club mounted or body worn bar used in all of these profiled events in the embodiments that do not employ a GPS receiver. | For embodiments that do not employ a GPS receiver, these profiles are used to determine the high probability that the golfer as taken a shot. |

What is claimed is:

1. A system configured to track parameters of a golf player's actual golf shots during play comprising:

at least one sensor configured to detect parameters indicative of actual game play including a golf ball strike and responsively generate at least one sensor signal indicative of the parameters;

a processing unit configured to automatically receive the at least one sensor signal without manual manipulation of the system, wherein processing unit includes an algorithm configured to automatically process the at least one signal and determine the occurrence of, and a difference between, a scorable stroke including the golf ball strike and a scorable whiff, and a non-scorable swing including a divot taken during a practice swing; and a display configured to render a visual image indicative of the golf ball strike and a parameter indicative of actual game play.

2. The system as specified in claim 1 wherein the parameter indicative of actual game play is correlated to a GPS position of the golf ball strike.

3. The system as specified in claim 2 further comprising a golf club including the sensor.

4. The system as specified in claim 2 wherein the sensor is configured to be attached to a golfer.

5. The system as specified in claim 4 further comprising a golf glove including the sensor coupled thereto.

6. The system as specified in claim 2 wherein the processing unit further includes a GPS sensor configured to determine the approximate location of the golf ball strike.

7. The system as specified in claim 6 wherein the processor includes memory configured to store data indicative of an actual golf hole, and the processor is configured to correlate the sensor signal to the actual golf hole stored data.

8. The system as specified in claim 7 wherein the display is configured to render an image indicative of the actual golf shot with the actual golf hole stored data.

9. The system as specified in claim 8 wherein the memory further includes data indicative of a course correlated to the actual golf hole.

10. The system as specified in claim 8 wherein the display is further configured to render the image to include the actual club used during the actual golf shot.

11. The system as specified in claim 1 wherein the sensor is configured to detect the occurrence of the actual golf ball strike as a function of a swing parameter.

12. The system as specified in claim 11 wherein the swing parameter includes a motion of the club used during a swing.

13. The system as specified in claim 12 wherein the swing parameter includes detecting a 3-Dimensional aspect of the club when swung by a golfer.

14. The system as specified in claim 11 wherein the sensor is configured to detect a sound of the actual ball strike.

15. The system as specified in claim 11 wherein the sensor is configured to detect a vibration of the club used during the actual ball strike.

16. The system as specified in claim 1 wherein the sensor comprises an accelerometer.

17. The system as specified in claim 1 wherein the processing unit includes characteristic profiles, and the algorithm is configured to compare the at least one signal indicative of the parameters to the characteristic profiles to determine the occurrence of, and a difference between, a scorable stroke including the golf ball strike and a scorable whiff, and a non-scorable swing including a divot taken during a practice swing.

18. The system as specified in claim 17 wherein the algorithm is configured to perform multiple processes to compare the at least one signal indicative of the parameters to the characteristic profiles.

19. The system as specified in claim 18 wherein the multiple processes comprise the combination of determining a step function delta characteristic of the golf ball strike, and a sound of a ball strike or a vibration of a club used during the golf ball strike.

20. The system as specified in claim 19 wherein the multiple processes also include determining a GPS location change.

21. The system as specified in claim 19 wherein the multiple processes also include determining the handling of a club.

22. The system as specified in claim 18 comprising a plurality of said sensors providing a plurality of said sensor signals, wherein the processing unit is configured to process the plurality of sensor signals.

23. The system as specified in claim 17 wherein the at least one sensor determines the ID of a club.

24. The system as specified in claim 23 wherein the at least one sensor is an RFID device configured to be attached to a golf club.

25. The system as specified in claim 1 wherein the processing unit includes a receiver configured to receive the at least one sensor signal.

* * * * *